US012351422B2

(12) United States Patent
Ohashi

(10) Patent No.: US 12,351,422 B2
(45) Date of Patent: Jul. 8, 2025

(54) IMAGE FORMING APPARATUS

(71) Applicant: CANON KABUSHIKI KAISHA, Tokyo (JP)

(72) Inventor: Yohei Ohashi, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 244 days.

(21) Appl. No.: 18/320,827

(22) Filed: May 19, 2023

(65) Prior Publication Data

US 2023/0416032 A1 Dec. 28, 2023

(30) Foreign Application Priority Data

Jun. 22, 2022 (JP) ..... 2022-100215

(51) Int. Cl.
*B65H 5/06* (2006.01)
*B65H 7/02* (2006.01)
*B65H 85/00* (2006.01)

(52) U.S. Cl.
CPC ..... *B65H 5/062* (2013.01); *B65H 7/02* (2013.01); *B65H 85/00* (2013.01); *B65H 2513/10* (2013.01); *B65H 2513/50* (2013.01); *B65H 2515/32* (2013.01); *B65H 2515/70* (2013.01); *B65H 2555/26* (2013.01)

(58) Field of Classification Search
CPC . B65H 5/062; B65H 7/00; B65H 7/02; B65H 85/00; B65H 2513/10; B65H 2513/50
See application file for complete search history.

(56) References Cited

U.S. PATENT DOCUMENTS

2011/0285332 A1 11/2011 Pollock
2020/0136541 A1* 4/2020 Morita ..... B65H 7/06
2020/0393790 A1* 12/2020 Tajiri ..... G03G 21/186

FOREIGN PATENT DOCUMENTS

JP 2005039955 A 2/2005

* cited by examiner

*Primary Examiner* — Prasad V Gokhale
(74) *Attorney, Agent, or Firm* — Canon U.S.A., Inc. IP Division

(57) ABSTRACT

An image forming apparatus includes an image forming unit to form an image on a sheet, a conveyance roller, a motor, a gear train, a detection unit to detect motor driving current, a phase determination unit to determine a motor rotor rotation phase, and a control unit having first and second control modes. The control unit rotates the rotor to rotate the conveyance roller in a predetermined direction, and rotates the conveyance roller in a direction opposite to the predetermined direction. The control unit controls the driving current in the second control mode, and then switches, in response to a value corresponding to a rotor rotation speed having reached a target speed, from the second control mode to the first control mode to control the driving current. The target speed is a speed which corresponds to a speed when the conveyance roller conveys the sheet and is a constant value.

4 Claims, 8 Drawing Sheets

IMAGE FORMING APPARATUS

BACKGROUND

Field

The present disclosure relates to control of a motor used for an image forming apparatus.

Description of the Related Art

Conventionally, a control method called "vector control" has been known as a method for controlling a motor. In the vector control, a motor is controlled by controlling a current value in a rotating coordinate system with a rotation phase of a rotor in the motor as a reference. Specifically, a control method for controlling a motor by performing phase feedback control has been known. In the phase feedback control, a current value in a rotating coordinate system is controlled so that a deviation between a command phase and a rotation phase of a rotor is small. Further, a method for controlling a motor by performing speed feedback control has been known. In the speed feedback control, a current value in the rotating coordinate system is controlled so that a deviation between a command speed and a rotation speed of a rotor is small.

In the vector control, driving current flowing through a wound wire of the motor is expressed by a q axis component (torque current component) which is a current component for generating torque for rotating a rotor, and a d axis component (excitation current component) which is a current component having an influence on the intensity of magnetic flux penetrating through the wound wire of the motor. The controlling of a value of the torque current component in accordance with a change of load torque on the rotor efficiently generates torque to be applied to rotate the rotor. This results in the control of an increase in sound volume of the motor and an increase in power consumption of the motor which are caused by excess torque.

For the vector control, a configuration which determines a rotation phase of a rotor is to be provided. United States Patent Application Publication No. 2011/0285332 discusses determining a rotation phase of a rotor based on induced voltage occurring in a wound wire in each phase of a motor resulting from the rotation of the rotor.

A magnitude of the induced voltage occurring in the winding wire becomes smaller with a lower rotation speed of the rotor. There is a possibility that the rotation phase cannot be accurately determined in a case where a magnitude of the induced voltage occurring in the wound wire is not sufficiently large to determine the rotation phase of the rotor. In other words, accuracy in determining the rotation phase of the rotor is more likely to drop with a lower rotation speed.

To address this, Japanese Patent Application Laid Open No. 2005-039955 discusses a configuration which employs constant current control for controlling a motor by supplying a predetermined current to a wound wire of a motor in a case where a command speed of a rotor is lower than a predetermined rotation speed. In the constant current control, neither the phase feedback control nor the speed feedback control are performed. Further, a configuration in which vector control is used in a case where a command speed of the rotor is the predetermined rotation speed or more is discussed. In other words, according to Japanese Patent Application Laid Open No. 2005-039955, a control method for controlling the motor is switched from constant current control to vector control in a period in which the motor is accelerated.

It has been known that a typical image forming apparatus rotates a conveyance roller in an opposite direction when an image is to be formed on a second surface of a recording medium with an image formed on a first surface and then conveys the recording medium to a two-sided path (United States Patent Application Publication No. 2020/0393790). More specifically, the image forming apparatus stops a motor that is being rotated in a first direction and is driving the conveyance roller and rotates the motor in a second direction opposite to the first direction, thus rotating the conveyance roller in the opposite direction.

When the motor rotated in the first direction is stopped, a gap (backlash) occurs between a gear arranged on a rotation shaft of the motor and a gear arranged on a rotation shaft of the second load. If rotation of the motor in the second direction is started in this state, because of the backlash, the gear arranged on the rotation shaft of the motor and the gear arranged on the rotation shaft of the second load are engaged in a period in which the motor being rotated in the second direction is accelerated. In other words, in a period in which the motor is accelerated, load torque applied to the motor increases due to engagement of the gear arranged on the rotation shaft of the motor and the gear arranged on the rotation shaft of the second load.

When the load torque is increased, the rotation speed of the rotor of the motor decreases. For example, in the configuration discussed in Japanese Patent Application Laid Open No. 2005-039955, if a rotation speed of the rotor of the motor decreases immediately after a control method of the motor is switched from constant current control to vector control, there is a possibility that the rotation phase of the rotor of the motor cannot be determined with high accuracy. As a result, the vector control cannot be performed with high accuracy, so that control of the motor may become unstable.

SUMMARY

The present disclosure is directed to a technique for preventing unstable control of a motor.

According to an aspect of the present disclosure, an image forming apparatus includes an image forming unit configured to form an image on a sheet, a conveyance roller configured to convey, after inverting a front and a back of the sheet with a first surface on which the image forming unit has formed an image, the sheet to the image forming unit, a motor configured to drive the conveyance roller, a gear train configured to transmit driving force of the motor to the conveyance roller, a detection unit configured to detect driving current flowing through a wound wire of the motor, a phase determination unit configured to determine a rotation phase of a rotor of the motor based on the driving current detected by the detection unit, and a control unit having a first control mode in which vector control for controlling driving current flowing through the wound wire of the motor is performed based on a torque current component which generates torque in the rotor and is expressed in a rotating coordinate system with the rotation phase determined by the phase determination unit as a reference, and a second control mode in which driving current flowing through the wound wire is controlled based on current with a magnitude determined in advance, wherein the control unit rotates the conveyance roller in a predetermined direction by rotating the rotor in a first direction, and rotates the conveyance roller in a direction opposite to the predetermined direction by rotating the rotor in a second direction opposite to the first direction, wherein the control unit starts controlling the driving current in the second control mode, and then switches, in response to a value corresponding to a rotation speed of the rotor having reached a target speed, a control mode for controlling the driving current from the second control mode to the first control mode, and wherein the target speed is a speed which corresponds to a speed when the conveyance roller conveys the sheet and is a constant value.

Further features of the present disclosure will become apparent from the following description of exemplary embodiments with reference to the attached drawings.

DESCRIPTION OF THE EMBODIMENTS

Hereinafter, exemplary embodiments of the present disclosure will be described with reference to the accompanying drawings. Shapes and relative arrangement of constituent elements described in the below-described exemplary embodiments should be changed as appropriate depending on a configuration and various conditions of an apparatus to which the present disclosure is applied, and the scope of the present disclosure are not intended to be limited to the below-described exemplary embodiments. Although the present disclosure is described with respect to a case where a motor control apparatus is arranged on an image forming apparatus, the motor control apparatus is also arranged on an apparatus other than the image forming apparatus. For example, the motor control apparatus is also used for a sheet conveyance apparatus for conveying sheets, such as recording media and documents.

[Image Forming Apparatus]

Figure 1:
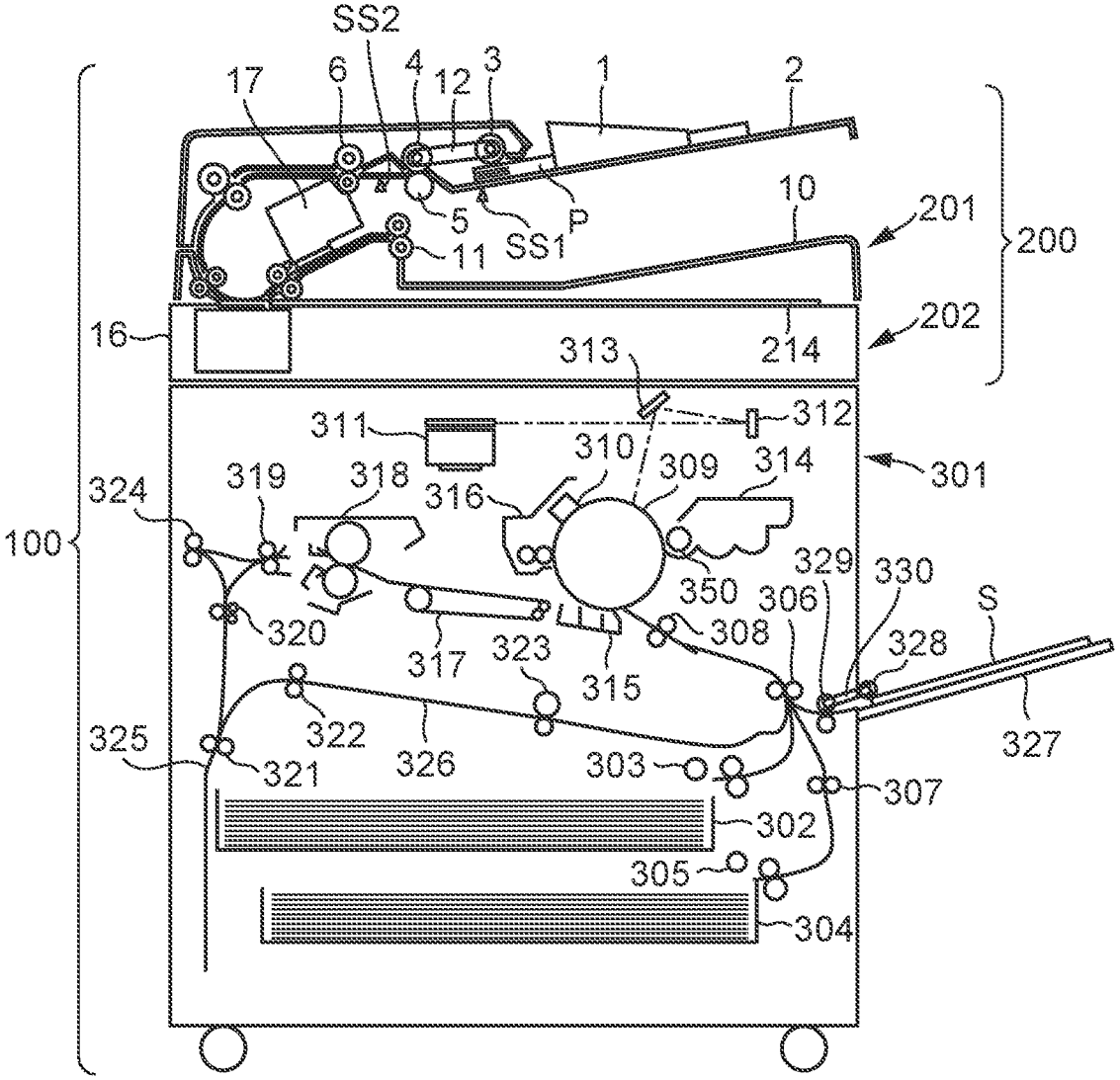
FIG. 1 is a cross-sectional diagram illustrating an image forming apparatus according to a first exemplary embodiment.

FIG. 1 is a cross-sectional diagram illustrating a configuration of an electrophotographic monochrome copying machine (hereinafter, called "image forming apparatus") 100 including a sheet conveyance apparatus employed in a first exemplary embodiment. The image forming apparatus 100 is not limited to a copying machine, and may be a facsimile apparatus, a printing apparatus, or a printer. A recording method is not limited to an electrophotographic method, and may be an ink jet method. Further, a recording format of the image forming apparatus may be either a monochrome format or a color format.

Hereinafter, a configuration and a function of the image forming apparatus 100 will be described with reference to FIG. 1. As illustrated in FIG. 1, the image forming apparatus 100 includes a document reading apparatus 200 and an image printing apparatus 301.

<Document Reading Apparatus>

The document reading apparatus 200 includes a document feeding apparatus 201 for feeding a piece (sheet) of document to a reading position. Pieces of document P stacked on a document stacking portion 2 of the document feeding apparatus 201 are fed by a pickup roller 3 one by one and conveyed by a feeding roller 4. A separation roller 5 which is brought into pressure-contact with the feeding roller 4 is arranged at a position facing the feeding roller 4. The separation roller 5 is rotated when load torque greater than or equal to a predetermined torque is applied thereto. The separation roller 5 has the function of separating two pieces of document stacked on top of each other which have been fed thereto.

The pickup roller 3 and the feeding roller 4 are coupled to each other by a swing arm 12. The swing arm 12 is supported by a rotation shaft of the feeding roller 4 to be rotationally movable with the rotation shaft of the feeding roller 4 as the center.

Each piece of the document P is conveyed by respective rollers including the feeding roller 4 and discharged to a discharge tray 10 by discharge rollers 11. As illustrated in FIG. 1, the document stacking portion 2 includes a document set sensor SS1 for detecting whether a document is stacked on the document stacking portion 2. A sheet sensor SS2 for detecting a leading end of a document (presence or absence of a document) is arranged on a conveyance path through which the document passes.

A reading apparatus 202 includes a document reading unit 16 for reading an image on a first surface of a conveyed piece of document P. The image information read by the document reading unit 16 is output to the image printing apparatus 301.

The document reading apparatus 200 includes a document reading unit 17 for reading an image on a second surface of the conveyed piece of document. The image information read by the document reading unit 17 is output to the image printing apparatus 301 through a method similar to the method performed by the document reading unit 16.

Reading of a document is performed as described above. In other words, the document feeding apparatus 201 and the reading apparatus 202 function as the document reading apparatus 200.

There are two modes for reading a document, a first reading mode and a second reading mode. In the first reading mode, an image of a conveyed piece of document is read through the above-described method. In the second reading mode, an image of a piece of document placed on a document platen glass plate 214 of the reading apparatus 202 is read by the document reading unit 16 which is moved at a constant speed. Normally, images of pieces of document in sheet form are read in the first reading mode, and images of pieces of bound document, such as a book and a brochure, are read in the second reading mode.

The image printing apparatus 301 includes therein sheet storing trays 302 and 304.

The sheet storing trays 302 and 304 can store recording media of different types. For example, A4-size standard paper is stored in the sheet storing tray 302, and A4-size thick paper is stored in the sheet storing tray 304. The recording media are materials on which images are formed by the image forming apparatus 100, and include, for example, sheets of paper, resin sheets, fabrics, overhead projector (OHP) sheets, and labels.

Each of the recording media stored in the sheet storing tray 302 is fed by a feeding roller 303 and conveyed to registration rollers 308 by conveyance rollers 306. Each of the recording media stored in the sheet storing tray 304 is fed by a feeding roller 305 and conveyed to the registration rollers 308 by conveyance rollers 307 and 306.

An image signal output from the document reading apparatus 200 is input to a light scanning apparatus 311 which includes a semiconductor laser and a polygonal mirror. An outer circumferential surface of a photosensitive drum 309 serving as a photosensitive member is charged by a charging device 310. After the outer circumferential surface of the photosensitive drum 309 is charged, laser light based on the image signal input to the light scanning apparatus 311 from the document reading apparatus 200 is emitted to the outer circumferential surface of the photosensitive drum 309 from the light scanning apparatus 311 via the polygonal mirror and mirrors 312 and 313. Thus, an electrostatic latent image is formed on the outer circumferential surface of the photosensitive drum 309.

A development device 314 serving as an image forming unit includes a development roller 350 as a developer bearing member. The electrostatic latent image formed on the outer circumferential surface of the photosensitive drum 309 is developed with developer (toner) borne by the development roller 350, and a toner image is formed on the outer circumferential surface of the photosensitive drum 309.

The toner image formed on the photosensitive drum 309 is transferred to a recording medium by a transfer charging device 315 serving as a transfer unit arranged at a position facing the photosensitive drum 309 (such a position may be referred to as transfer position). The registration rollers 308 convey the recording medium to the transfer position at this transfer timing.

The recording medium on which the toner image is transferred through the above-described processing is conveyed to a fixing device 318 serving as an image forming unit by a conveyance belt 317 and heated and pressurized by the fixing device 318, and the toner image is fixed to the recording medium. As described above, the image forming apparatus 100 forms an image on the recording medium.

In a case where image forming is performed in a one-sided printing mode, a recording medium passing through the fixing device 318 is discharged to a discharge tray (not illustrated) by discharge rollers 319 and 324. In a case where image forming is performed in a two-sided printing mode, a recording medium is conveyed to an inverting path 325 by discharge rollers 319, conveyance rollers 320, and inverting rollers 321 after the fixing device 318 executes fixing processing on the first surface of the recording medium. The recording medium is then conveyed to a two-sided path 326 after front and back surfaces thereof are inverted by the inverting rollers 321. The recording medium conveyed to the two-sided path 326 is conveyed to the registration rollers 308 again by the respective rollers such as the conveyance rollers 323, and an image is formed on a second surface of the recording medium through the above-described method. Thereafter, the recording medium is discharged to the discharge tray (not illustrated) by the discharge rollers 319 and 324.

In a case where a recording medium is discharged to the outside of the image forming apparatus 100 in a state where a first surface thereof on which an image is formed faces downward, the recording medium passing through the fixing device 318 is conveyed to the conveyance rollers 320 via the discharge rollers 319. Thereafter, rotation of the conveyance rollers 320 is reversed immediately before a trailing end of the recording medium passes through a nip portion of the conveyance rollers 320. Thus, the recording medium is discharged to the outside of the image forming apparatus 100 via the discharge rollers 324 in a state where the first surface of the recording medium faces downward.

The configuration and the function of the image forming apparatus 100 have been described as the above.

Figure 2:
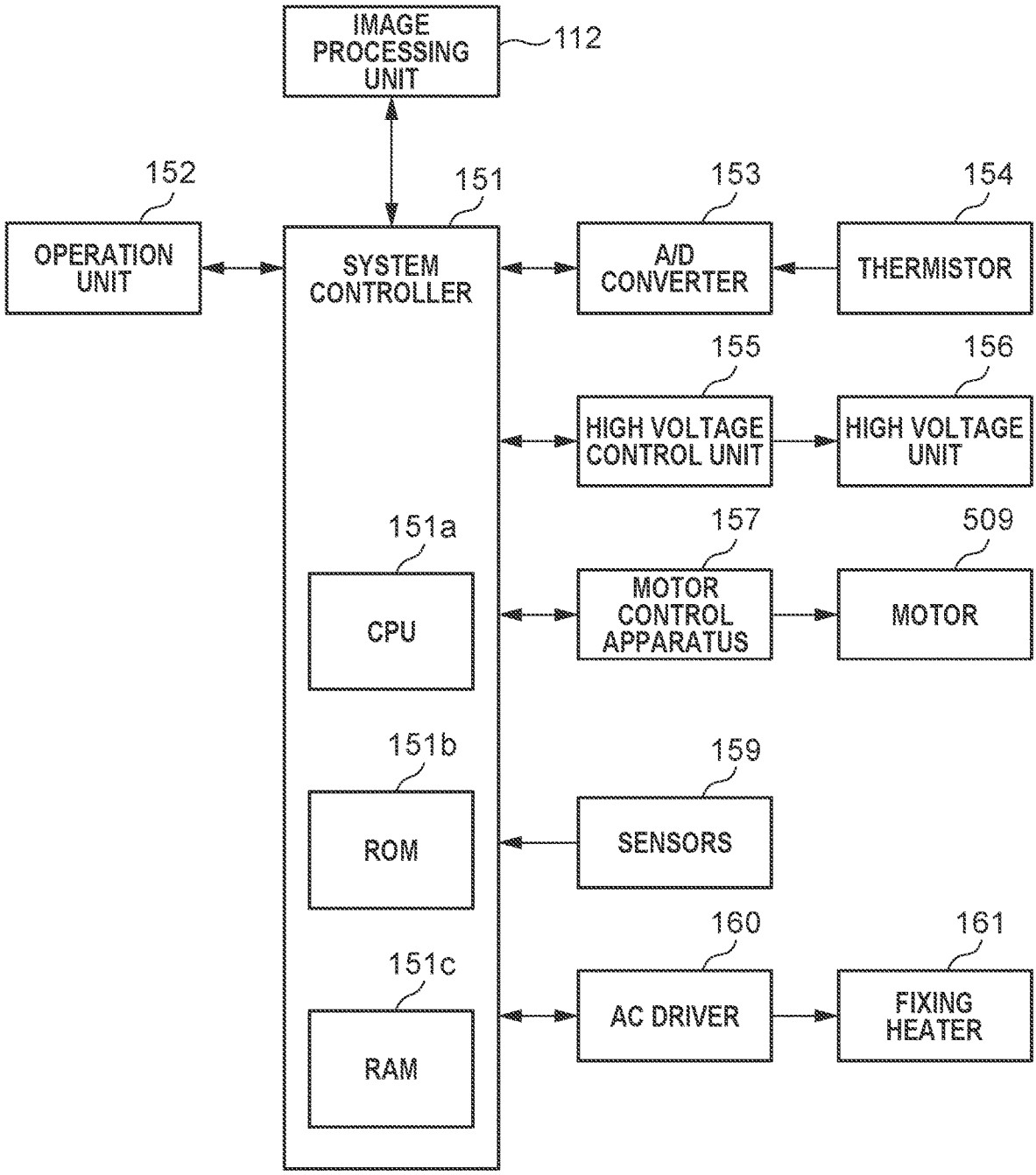
FIG. 2 is a block diagram illustrating a control configuration of the image forming apparatus.

FIG. 2 is a block diagram illustrating an example of a control configuration of the image forming apparatus 100. As illustrated in FIG. 2, a system controller 151 includes a central processing unit (CPU) 151*a*, a read-only memory (ROM) 151*b*, and a random access memory (RAM) 151*c*. The system controller 151 is connected to an image processing unit 112, an operation unit 152, an analog/digital (A/D) converter 153, a high voltage control unit 155, a motor control apparatus 157, sensors 159, and an alternating-current (AC) driver 160. The system controller 151 is capable of transmitting and receiving data and commands to/from the respective units connected thereto.

The CPU 151*a* executes various types of sequence relating to a predetermined image forming sequence by reading and executing various programs stored in the ROM 151*b*.

The RAM 151*c* serves as a storage device. Various types of data, for example, a setting value of the high voltage control unit 155, a command value of the motor control apparatus 157, and information received from the operation unit 152 are stored in the RAM 151*c*.

The system controller 151 transmits data of setting values for apparatuses inside the image forming apparatus 100 to the image processing unit 112. The data of setting values are to be used in image processing of the image processing unit 112. The system controller 151 further receives signals from the sensors 159 and sets the setting value of the high voltage control unit 155 based on the received signals.

The high voltage control unit 155 supplies a certain voltage to the high voltage units 156 (i.e., the charging device 310, the development device 314, and the transfer charging device 315) depending on the setting values set by the system controller 151. The sensors 159 includes a sensor for detecting a recording medium conveyed by the conveyance rollers.

The motor control apparatus 157 controls the motor 509 that drives the inverting rollers 321 based on the command output from the CPU 151*a*. Driving force of the motor 509 is transmitted to the inverting rollers 321 via a gear train (not illustrated). In FIG. 2, while only the motor 509 is illustrated as a motor included in the image forming apparatus 100, in practice, a plurality of motors is arranged on the image forming apparatus 100. The plurality of motors may be controlled by one motor control apparatus. Further, in FIG. 2, while only one motor control apparatus is provided on the image forming apparatus 100, in practice, a plurality of motor control apparatuses is provided on the image forming apparatus 100.

The A/D converter 153 receives a detection signal detected by a thermistor 154 for detecting the temperature of a fixing heater 161, converts the detection signal from an analog signal to a digital signal, and transmits the digital signal to the system controller 151. The system controller 151 controls the AC driver 160 based on the digital signal received from the A/D converter 153. The AC driver 160 controls the fixing heater 161 so that the temperature of the fixing heater 161 reaches a temperature at which fixing processing is performed. The fixing heater 161 is included in the fixing device 318 and used for the fixing processing.

The system controller 151 controls the operation unit 152 to display an operation screen on which the user performs operation to set a type of recording medium to be used (hereinafter, called "paper type") on a display unit arranged on the operation unit 152. The system controller 151 receives the information set by the user from the operation unit 152, and controls the operation sequence of the image forming apparatus 100 based on the information set by the user. The system controller 151 transmits the information indicating a state of the image forming apparatus 100 to the operation unit 152. Examples of the information indicating a state of the image forming apparatus 100 include information about the number of sheets on which images are formed, information about a progress status of image forming operation, and information about sheet jam and erroneous conveyance of overlapping sheets occurring in the document feeding apparatus 201 and the image printing apparatus 301. The operation unit 152 displays the information received from the system controller 151 on the display unit.

As described above, the system controller 151 controls the operation sequence of the image forming apparatus 100.

[Motor Control Apparatus]

Next, a motor control apparatus according to the present exemplary embodiment will be described. The motor control apparatus according to the present exemplary embodiment controls a motor through either one of control methods, specifically, the vector control as a first control mode or the constant current control as a second control mode. In the below-described exemplary embodiment, the following control is performed based on a rotation phase θ, a command phase θ_ref, and a current phase, which serve as electrical angles. Alternatively, the electrical angle may be converted to a mechanical angle and the following control is performed based on the mechanical angle.

<Vector Control>

Initially, a method with which the motor control apparatus 157 according to the present exemplary embodiment performs vector control will be described with reference to FIGS. 3 and 4. A sensor, such as a rotary encoder for detecting a rotation phase of a rotor of a motor, is not arranged on the motor described below.

Figure 3:
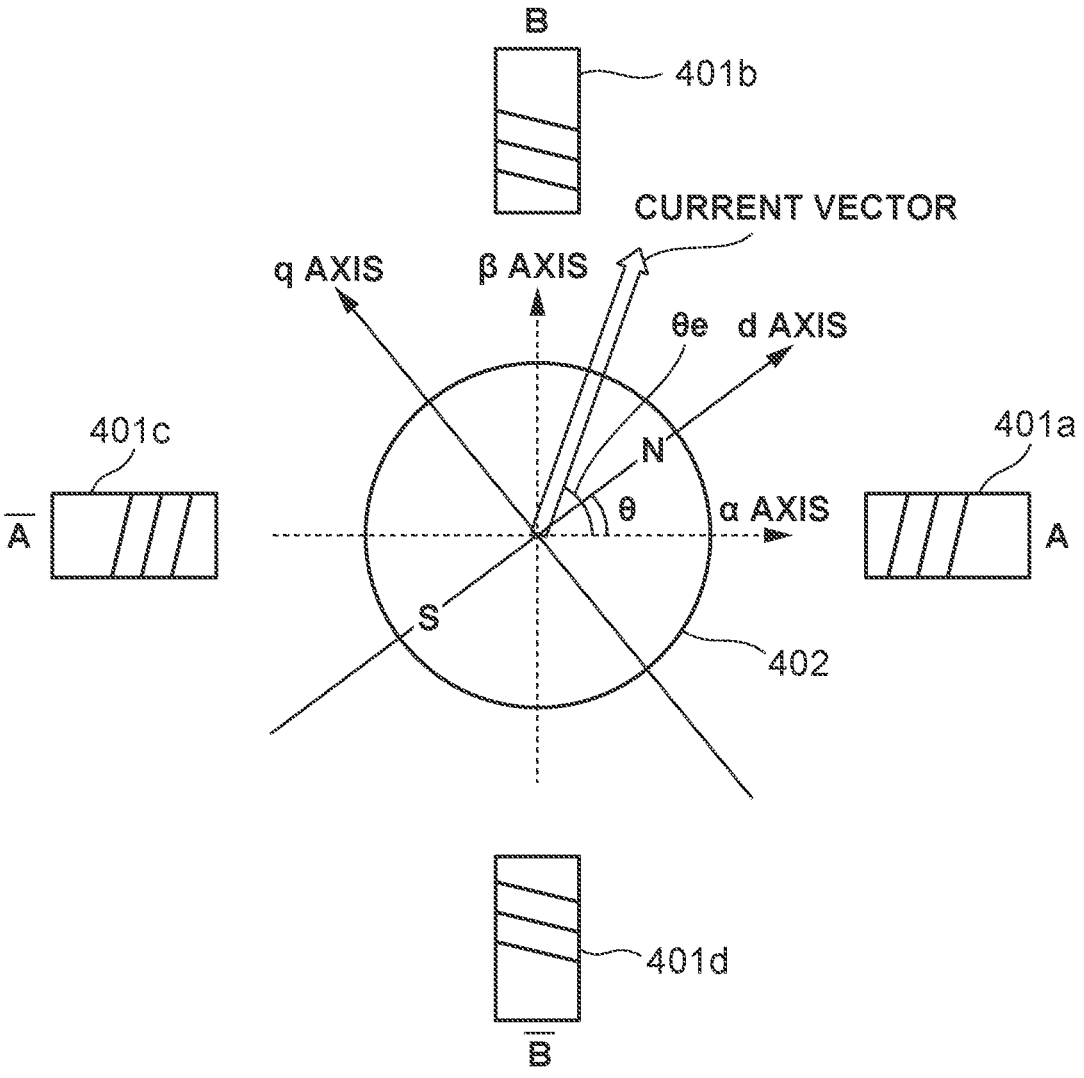
FIG. 3 is a diagram illustrating a relationship between a two-phase motor having a phase A and a phase B and a rotating coordinate system expressed by a d axis and a q axis.

FIG. 3 is a diagram illustrating a relationship between a step motor (hereinafter, called "motor") 509 with two phases, namely, a phase A (first phase) and a phase B (second phase), and a rotating coordinate system expressed by a d axis and a q axis. FIG. 3 defines an α axis which corresponds to a wound wire in the phase A and a β axis corresponding to a wound wire in the phase B in a stationary coordinate system. In FIG. 3, the d axis in a direction parallel to a direction of magnetic flux generated by a magnetic pole of a permanent magnet used for the rotor 402 is defined, and the q axis in a direction advancing by 90 degrees in a counterclockwise direction (i.e., a direction orthogonal to the d axis) from the d axis is defined. An angle formed by the α axis and the d axis is defined as an angle θ, and a rotation phase of the rotor 402 is expressed by the angle θ. In the vector control, a rotating coordinate system with the rotation phase θ of the rotor 402 as a reference is used. Specifically, in the vector control, a q axis component (torque current component) for generating torque in the rotor 402 and a d axis component (excitation current component) having an influence on intensity of magnetic flux penetrating through the wound wire are used. The q axis component and the d axis component are current components of a current vector corresponding to driving current flowing through the wound wire, in the rotating coordinate system.

The vector control is a control method for controlling a motor by performing phase feedback control in which a value of the torque current component and a value of the excitation current component are controlled so that a deviation between a command phase indicating a target phase of the rotor 402 and an actual rotation phase is small. Alternatively, there is a control method for controlling a motor by performing speed feedback control in which a value of the torque current component and a value of the excitation current component are controlled so that a deviation between a command speed indicating a target speed of the rotor 402 and an actual rotation speed is small.

Figure 4:
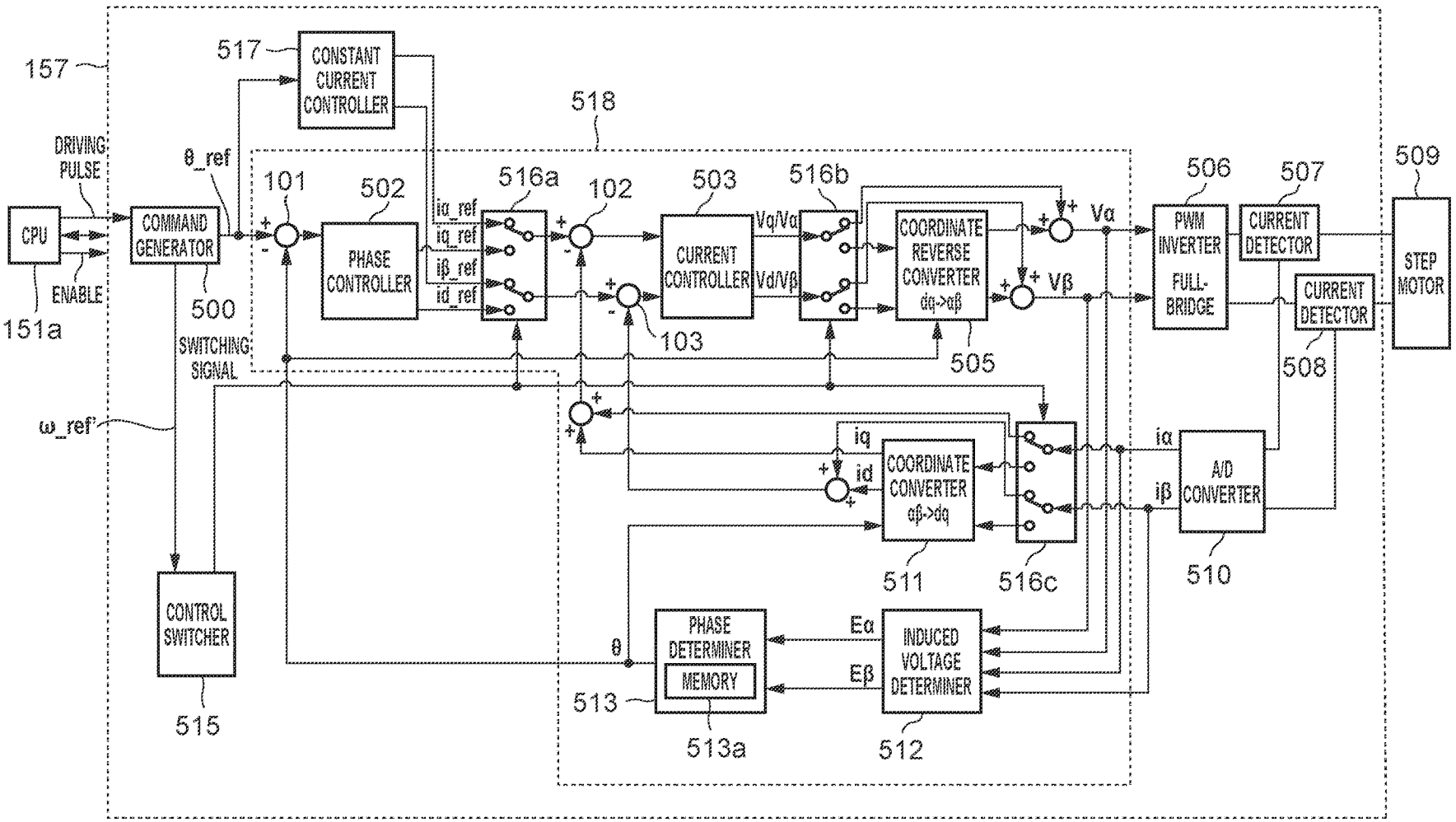
FIG. 4 is a block diagram illustrating a configuration of a motor control apparatus according to the first exemplary embodiment.

FIG. 4 is a block diagram illustrating an example of a configuration of the motor control apparatus 157 for controlling the motor 509. The motor control apparatus 157 includes at least one application specific integrated circuit (ASIC), and executes the below described functions.

As illustrated in FIG. 4, the motor control apparatus 157 includes a constant current controller 517 for performing constant current control and a vector controller 518 for performing vector control.

The motor control apparatus 157 includes, as a circuit for performing the vector control, a phase controller 502, a current controller 503, a coordinate reverse converter 505, a coordinate converter 511, and a pulse width modulation (PWM) inverter 506 for supplying driving current to the wound wires of the motor 509. The coordinate converter 511 performs coordinate conversion to convert the current vector corresponding to driving current flowing through the wound wires in the phases A and B of the motor 509 from the stationary coordinate system expressed by the α axis and the β axis into the rotating coordinate system expressed by the q axis and the d axis. As a result, the driving current flowing through the wound wires is expressed by a current value of the q axis component (q axis current) and a current value of the d axis component (d axis current) which are current values in the rotating coordinate system. The q axis current corresponds to torque current which generates torque in the rotor 402 of the motor 509. The d axis current corresponds to excitation current having an influence on intensity of the magnetic flux penetrating through the wound wires of the motor 509. The motor control apparatus 157 can control individually the q axis current and the d axis current. This enables the motor control apparatus 157 to efficiently generate torque to be applied to rotate the rotor 402 by controlling the q axis current in accordance with the load torque applied to the rotor 402. In other words, in the vector control, a magnitude of the current vector illustrated in FIG. 3 is changed in accordance with the load torque applied to the rotor 402.

The motor control apparatus 157 determines the rotation phase θ of the rotor 402 of the motor 509 through a method described below and performs the vector control based on a result of the determination. The CPU 151*a* outputs a driving pulse to the command generator 500 as a command to drive the motor 509, based on the operation sequence of the motor 509. The operation sequence) of the motor 509 (driving pattern) is stored in, for example, the ROM 151*b*, and the CPU 151*a* outputs a driving pulse based on the operation sequence stored in the ROM 151*b*.

The command generator 500 generates a command phase θ_ref which expresses a target phase of the rotor 402 based on the driving pulse output from the CPU 151*a*, and outputs the result. A configuration of the command generator 500 will be described below.

A subtracter 101 calculates a deviation between the rotation phase θ of the rotor 402 of the motor 509 and the command phase θ_ref, and outputs the result.

The phase controller 502 obtains a deviation Δθ at a period T (e.g., 200 μs). The phase controller 502 generates a q axis current command value iq_ref and a d axis current command value id_ref based on proportional control (P), integral control (I), and differential control (D) so that the deviation Δθ to be obtained from the subtracter 101 is small, and outputs the generated values. Specifically, based on the P control, the I control, and the D control, the phase controller 502 generates the q axis current command value iq_ref and the d axis current command value id_ref so that the deviation Δθ obtained from the subtracter 101 is zero, and outputs the values. The P control is a control method for controlling a control target value based on a value proportional to a deviation between a command value and an estimate value. The I control is a control method for controlling a control target value based on a value proportional to a temporal integral of a deviation between a command value and an estimate value. The D control is a control method for controlling a control target value based on a value proportional to a time variation for a deviation between a command value and an estimate value.

The phase controller 502 according to the present exemplary embodiment generates the q axis current command value iq_ref and the d axis current command value id_ref based on the PID control. However, the present exemplary embodiment is not limited thereto. For example, the phase controller 502 may generate the q axis current command value iq_ref and the d axis current command value id_ref based on the PI control. In the present exemplary embodiment, the d axis current command value id_ref having an influence on the intensity of the magnetic flux penetrating through the wound wire is set to zero. However, the present exemplary embodiment is not limited thereto.

The driving current flowing through the wound wire in the phase A of the motor 509 is detected by the current detector 507, and converted into a digital value from an analog value by the A/D converter 510. The driving current flowing through the wound wire in the phase B of the motor 509 is detected by the current detector 508, and converted into a digital value from an analog value by the A/D converter 510. A period at which each of the current detectors 507 and 508 detects the current is, for example, a period less than or equal to the period T at which the phase controller 502 obtains the deviation Δθ (such a period is, e.g., 25 μs).

The current values of driving current converted to the digital values from the analog values by the A/D converter 510 are expressed as current values iα and iβ in the stationary coordinate system by the following equations by using a phase θe of the current vector illustrated in FIG. 3. The phase θe of the current vector is defined as an angle formed by the α axis and the current vector. A letter "I" represents a magnitude of the current vector.

$$i\alpha = I^* \cos \theta e \tag{1}$$

$$i\beta = I^* \sin \theta e \tag{2}$$

These current values iα and iβ are input to a coordinate converter 511 and an induced voltage determiner 512.

The coordinate converter 511 converts the current values iα and iβ in the stationary coordinate system into a current value iq of the q axis current and a current value id of the d axis current in the rotating coordinate system using the following equations.

$$id = \cos \theta^* i\alpha + \sin \theta^* i\beta \tag{3}$$

$$iq = \cos \theta^* i\alpha + \cos \theta^* i\beta \tag{4}$$

The coordinate converter 511 outputs the converted current value iq to the subtracter 102. The coordinate converter 511 outputs the converted current value id to the subtracter 103.

The subtracter 102 calculates a deviation between the q axis current command value iq_ref and the current value iq, and outputs the deviation to the current controller 503.

The subtracter 103 calculates a deviation between the d axis current command value id_ref and the current value id, and outputs the deviation to the current controller 503.

The current controller 503 generates the driving voltages Vq and Vd so that the respective deviations to be input is small based on the PID control. Specifically, the current controller 503 generates the driving voltages Vq and Vd so that the respective deviations to be input is zero, and outputs the driving voltages Vq and Vd to the coordinate reverse converter 505. Although the current controller 503 of the present exemplary embodiment generates the driving voltages Vq and Vd based on the PID control, the present exemplary embodiment is not limited thereto. For example, the current controller 503 may generate the driving voltages Vq and Vd based on the PI control.

The coordinate reverse converter 505 performs reverse conversion to convert the driving voltages Vq and Vd in the rotating coordinate system output from the current controller 503 into driving voltages Vα and Vβ in the stationary coordinate system using the following equations.

$$V\alpha = \cos \theta^* Vd - \sin \theta^* Vq \tag{5}$$

$$V\beta = \cos \theta^* Vd - \cos \theta^* Vq \tag{6}$$

The coordinate reverse converter 505 outputs the driving voltages Vα and Vβ obtained through the reverse conversion to the induced voltage determiner 512 and the PWM inverter 506.

The PWM inverter 506 includes a full-bridge circuit. The full-bridge circuit is driven by a pulse width modulation (PWM) signal based on the driving voltages Vα and Vβ received from the coordinate reverse converter 505. As a result, the PWM inverter 506 generates the driving currents iα and iβ in accordance with the driving voltages Vα and Vβ, and drives the motor 509 by supplying the driving currents iα and iβ to the wound wires of respective phases A and B of the motor 509. While the PWM inverter 506 of the present exemplary embodiment includes the full-bridge circuit, the PWM inverter 506 may include a half-bridge circuit.

Next, a process of determining the rotation phase θ will be described. Values of induced voltages Eα and Eβ which are induced in the wound wires in the phases A and B of the motor 509 by the rotation of the rotor 402 are used for determining the rotation phase θ of the rotor 402. The values of the induced voltages Eα and Eβ are determined (calculated) by the induced voltage determiner 512. More specifically, the induced voltages Eα and Eβ are determined using the following equations based on the current values iα and iβ input to the induced voltage determiner 512 from the A/D converter 510 and the driving voltages Vα and Vβ input to the induced voltage determiner 512 from the coordinate reverse converter 505.

$$E\alpha = V\alpha - R*i\alpha - L*di\alpha/dt \quad (7)$$

$$E\Theta = V\Theta - R*i\Theta - L*di\Theta/dt \quad (8)$$

Here, a resistance of the wound wire is denoted by "R", and an inductance of the wound wire is denoted by "L". The values of the resistance R and the inductance L of the wound wire are unique to the motor 509 in use, and these values are previously stored in the ROM 151*b* or a memory (not illustrated) arranged on the motor control apparatus 157.

The induced voltages Eα and Eβ determined by the induced voltage determiner 512 are output to the phase determiner 513.

The phase determiner 513 determines the rotation phase θ of the rotor 402 in the motor 509 using the following equation, based on a ratio between the induced voltage Eα and the induced voltage Eβ output from the induced voltage determiner 512.

$$\theta = \tan\hat{}-1(-E\beta/E\alpha) \quad (9)$$

In the present exemplary embodiment, the phase determiner 513 determines the rotation phase θ by performing calculation based on the formula 9, but this is not restrictive. Alternatively, the phase determiner 513 may determine the rotation phase θ by referencing a table which is stored in the ROM 151B and which indicates a relationship between the induced voltages Eα and Eβ and the rotation phase θ corresponding to the induced voltages Eα and Eβ.

The rotation phase θ of the rotor 402 thus obtained is input to the subtracter 101, the coordinate reverse converter 505, and the coordinate converter 511.

In a case where the vector control is performed, the motor control apparatus 157 repeatedly performs the above-described control.

As described above, the motor control apparatus 157 according to the present exemplary embodiment performs the vector control using the phase feedback control in which the current value in the rotating coordinate system is controlled so that a deviation between the command phase θ_ref and the rotation phase θ is small. Performing the vector control makes it possible to prevent the occurrence of a step-out state of the motor 509 and an increase in motor sound and power consumption in the motor 509 caused by excess torque.

<Constant Current Control>

Next, constant current control according to the present exemplary embodiment will be described.

In the constant current control, driving current flowing through the respective wound wires is controlled by supplying a predetermined current to the wound wires of the motor 509. More specifically, in the constant current control, driving current having a magnitude (amplitude) corresponding to torque obtained by adding a predetermined margin to torque expected to be used to rotate the rotor 402 is supplied to the wound wires so that the occurrence of a step-out state of the motor 509 is prevented even if fluctuation occurs in the load torque on the rotor 402. This control is performed because controlling of a magnitude of driving current based on a determined (estimated) rotation phase or a determined (estimated) rotation speed is not employed (i.e., feedback control is not performed) in the constant current control, so that the driving current cannot be adjusted in accordance with the load torque on the rotor 402. Torque applied to the rotor 402 becomes greater when a magnitude of current is greater. An amplitude corresponds to a magnitude of a current vector.

In the below-described exemplary embodiment, under the constant current control, the motor 509 is controlled by supplying a predetermined magnitude of current to the wound wires of the motor 509. Alternatively, under the constant current control, the motor 509 may be controlled by supplying current having a predetermined magnitude for each of the acceleration period and the deceleration period for the motor 509.

In FIG. 4, the command generator 500 outputs the command phase θ_ref to the constant current controller 517 based on the driving pulse output from the CPU 151*a*. The constant current controller 517 generates command values iα_ref and iβ_ref for current in the stationary coordinate system corresponding to the command phase θ_ref output from the command generator 500, and outputs the results. In the present exemplary embodiment, a magnitude of the current vector corresponding to the command values iα_ref and iβ_ref of the current in the stationary coordinate system remains constant.

Driving currents flowing through the wound wires in the phases A and B of the motor 509 are detected by the current detectors 507 and 508. The detected driving currents are converted into digital values from analog values by the A/D converter 510, as described above.

The current value iα output from the A/D converter 510 and the current command value iα_ref output from the constant current controller 517 are input to the subtracter 102. The subtracter 102 calculates a deviation between the current command value iα_ref and the current value iα, and outputs the deviation to the current controller 503.

The current value iβ output from the A/D converter 510 and the current command value iβ_ref output from the constant current controller 517 are input to the subtracter 103. The subtracter 103 calculates a deviation between the current command value iβ_ref and the current value iβ, and outputs the deviation to the current controller 503.

The current controller 503 outputs the driving voltages Vα and Vβ based on the PID control so that the deviations to be input is small. More specifically, the current controller 503 outputs the driving voltages Vα and Vβ so that the deviations to be input approximate zero.

Through the above-described method, the PWM inverter 506 drives the motor 509 by supplying the driving currents to the wound wires in the respective phases A and B of the motor 509 based on the driving voltages Vα and Vβ input thereto.

As described above, in the constant current control according to the present exemplary embodiment, neither the phase feedback control nor the speed feedback control is performed. In other words, in the constant current control according to the present exemplary embodiment, adjustment of driving current to be supplied to the wound wires in accordance with the rotation state of the rotor 402 is not performed. Accordingly, in the constant current control, current obtained by adding a predetermined margin to the current to be applied to rotate the rotor 402 is supplied to the wound wires in order to prevent occurrence of a step-out state of the motor 509.

<Command Generator>

Figure 5:
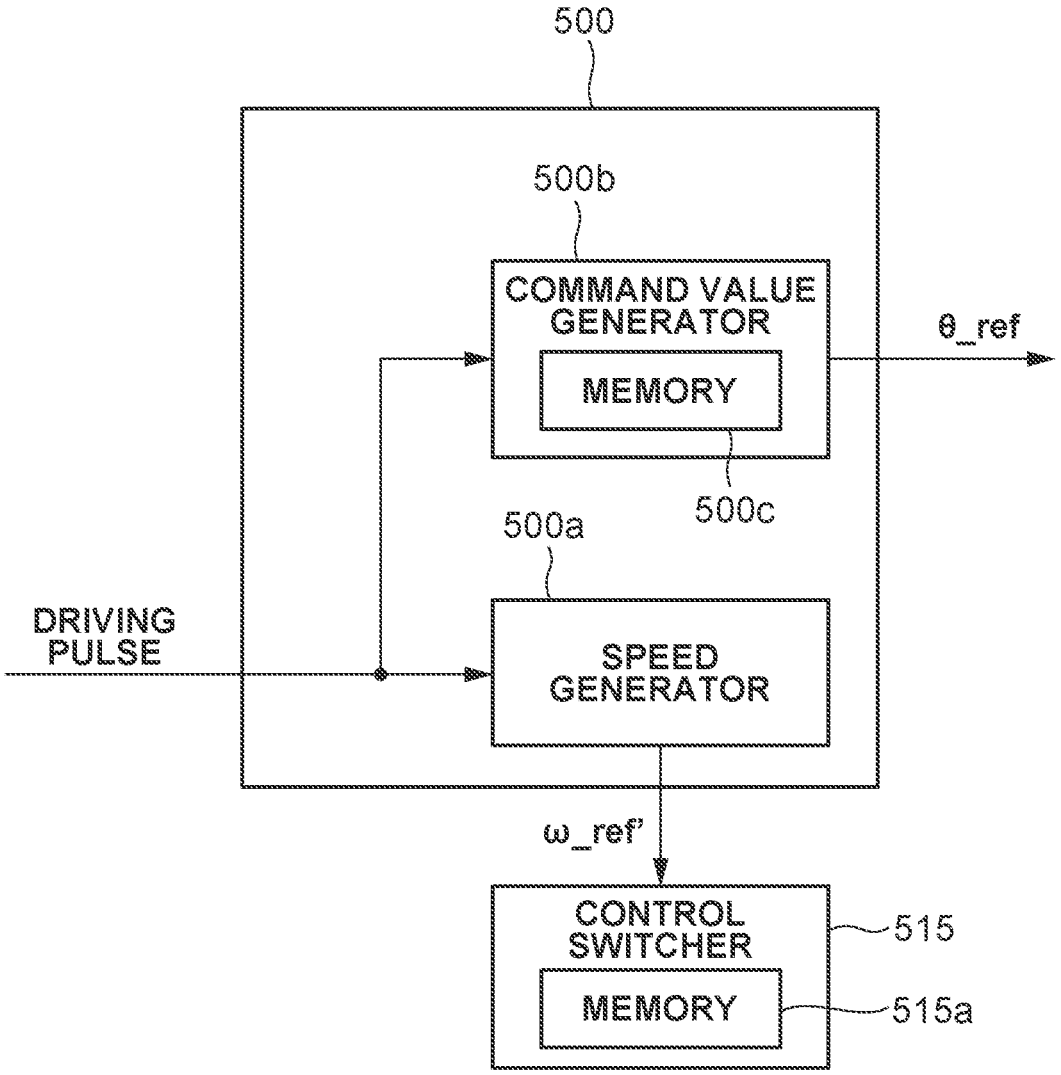
FIG. 5 is a block diagram illustrating a configuration of a command generator.

FIG. 5 is a block diagram illustrating a configuration of the command generator 500 according to the present exemplary embodiment. As illustrated in FIG. 5, the command generator 500 includes a speed generator 500*a* for generating a rotation speed ω_ref as a substitute for the command speed based on a driving pulse output from the CPU 151*a* and a command value generator 500*b* for generating a command phase θ_ref based on the driving pulse.

The speed generator 500*a* generates the rotation speed ω_ref based on a time interval of a falling edge of the continuous driving pulse, and outputs the rotation speed ω_ref to a control switcher 515, described below. The rotation speed ω_ref is changed at a period corresponding to a period of the driving pulse.

The command value generator 500*b* generates the command phase θ_ref using the following equation (10) based on the driving pulse output from the CPU 151*a*, and outputs the result.

$$\theta_ref=\theta ini+\theta step*n \quad (10)$$

In the equation (10), a phase (initial phase) of the rotor 402 when driving of the motor 509 is started is denoted by "θini".

An increased amount "θstep" is an increased amount (an amount of change) of the command phase θ_ref per driving pulse. The number of pulses to be input to the command value generator 500*b* is denoted by "n".

[Micro-Step Driving Method]

In the present exemplary embodiment, a micro-step driving method is used in the constant current control. A driving method used in the constant current control is not limited to the micro-step driving method, and other methods, including but not limited to a full-step driving method, may also be employed.

Figure 6:
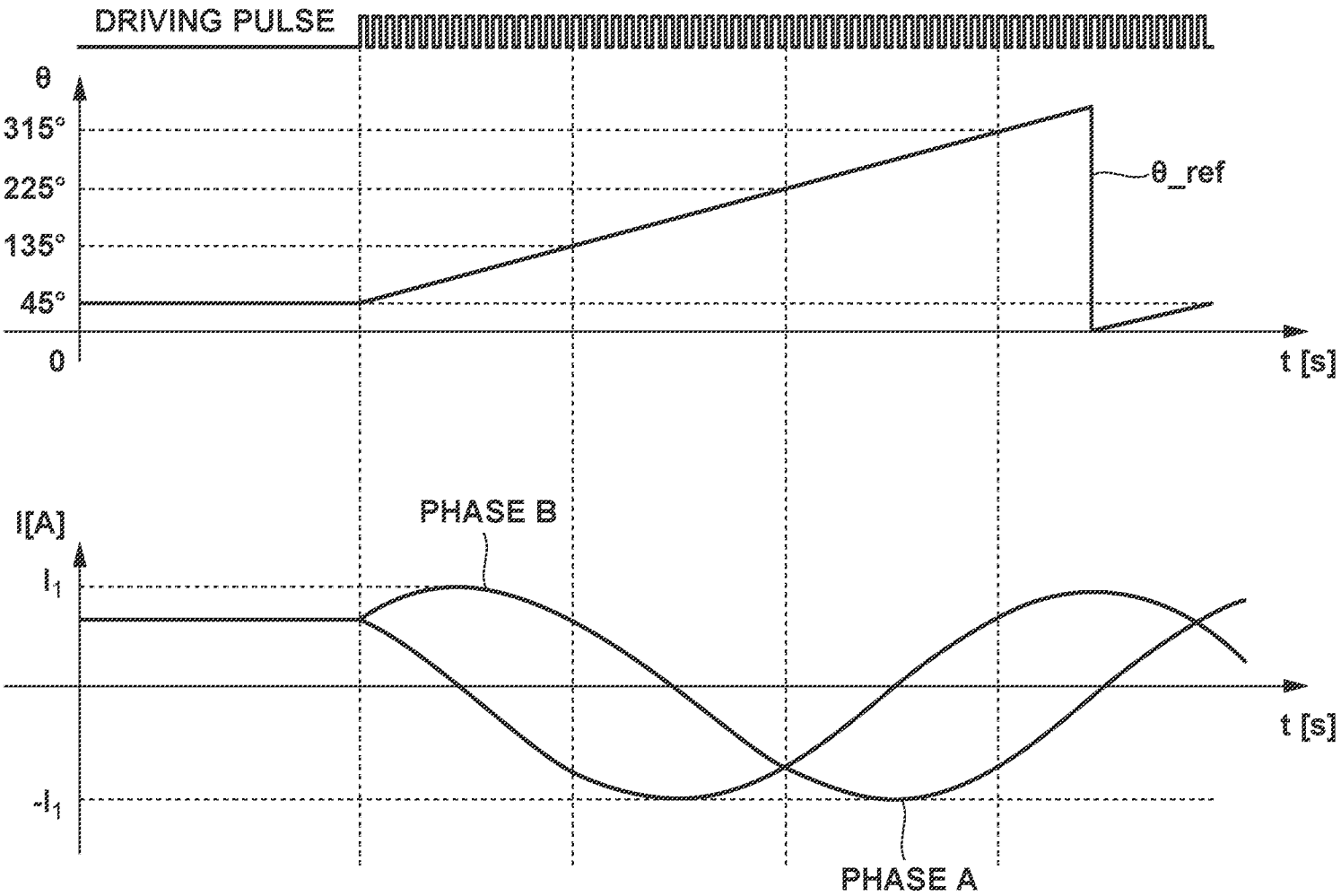
FIG. 6 is a diagram illustrating an example of a method for executing a micro-step driving method.

FIG. 6 is a diagram illustrating an example of a method of performing the micro-step driving method. FIG. 6 illustrates a driving pulse output from the CPU 151*a*, a command phase θ_ref generated by the command value generator 500*b*, and current flowing through the wound wires in the phases A and B.

A method of performing the micro-step driving according to the present exemplary embodiment will be described below with reference to FIGS. 5 and 6. The driving pulse and the command phase illustrated in FIG. 6 illustrate a state where the rotor 402 is rotated at a constant speed.

An advance amount of the command phase θ_ref in the micro-step driving method is 90°/N, an amount corresponding to one-Nth (1/N) (N is a positive integer) of is an advance amount of the command phase θ_ref in the full-step driving method. As a result, a current waveform is sinusoidally and smoothly changed as illustrated in FIG. 6, so that the rotation phase θ of the rotor 402 can be controlled more accurately.

In performing the micro-step driving, the command value generator 500*b* generates the command phase θ_ref using the following equation (11) based on the driving pulse output from the CPU 151*a*, and outputs the results.

$$\theta_ref=45°+90/N°*n \quad (11)$$

Thus, the command value generator 500*b* updates the command phase θ_ref by adding 90/N° to the command phase θ_ref in response to one driving pulse being input thereto. In other words, the number of driving pulses output from the CPU 151*a* corresponds to the command phase θ_ref. A period (frequency) of the driving pulse output from the CPU 151*a* corresponds to a target speed (command speed) of the rotor 402 of the motor 509.

<Switch between Vector Control and Constant Current Control>

Next, switch between the vector control and the constant current control according to the present exemplary embodiment will be described.

In the present exemplary embodiment, the below-described configuration is applied so that unstable control of the motor 509 is prevented.

As illustrated in FIG. 4, the motor control apparatus 157 according to the present exemplary embodiment has a configuration of switching the constant current control and the vector control. More specifically, the motor control apparatus 157 includes a control switcher 515 and change-over switches 516*a*, 516*b*, and 516*c*. The induced voltage determiner 512, the phase determiner 513, and the coordinate converter 519 may be in operation in a period in which the constant current control is being performed. A circuit that performs the constant current control may be in operation in a period in which the vector control is being performed.

The control switcher 515 switches a switching signal to "L" in a case where the constant current control is performed, and switches a switching signal to "H" in a case where the vector control is performed. As illustrated in FIG. 4, the switching signal is input to the change-over switches 516*a*, 516*b*, and 516*c*. The control switcher 515 outputs the switching signal at intervals of period same as the period T at which the CPU 151*a* outputs the rotation speed ω_ref.

In the present exemplary embodiment the CPU 151*a* outputs, to the motor control apparatus 157, the information indicating whether the motor 509 is rotated in a first direction or a second direction opposite to the first direction when the motor 509 is rotated. The control switcher 515 stores the information in the memory 515*a*.

The control switcher 515 determines a timing (switching timing) of switching the vector control and the constant current control based on the previous rotation direction of the motor 509 stored in the memory 515*a* and the information about the rotation direction output from the CPU 151*a*. The control switcher 515 determines the timing and then overwrites the information about the rotation direction output from the CPU 151*a* in the memory 515*a*.

Figure 7A:
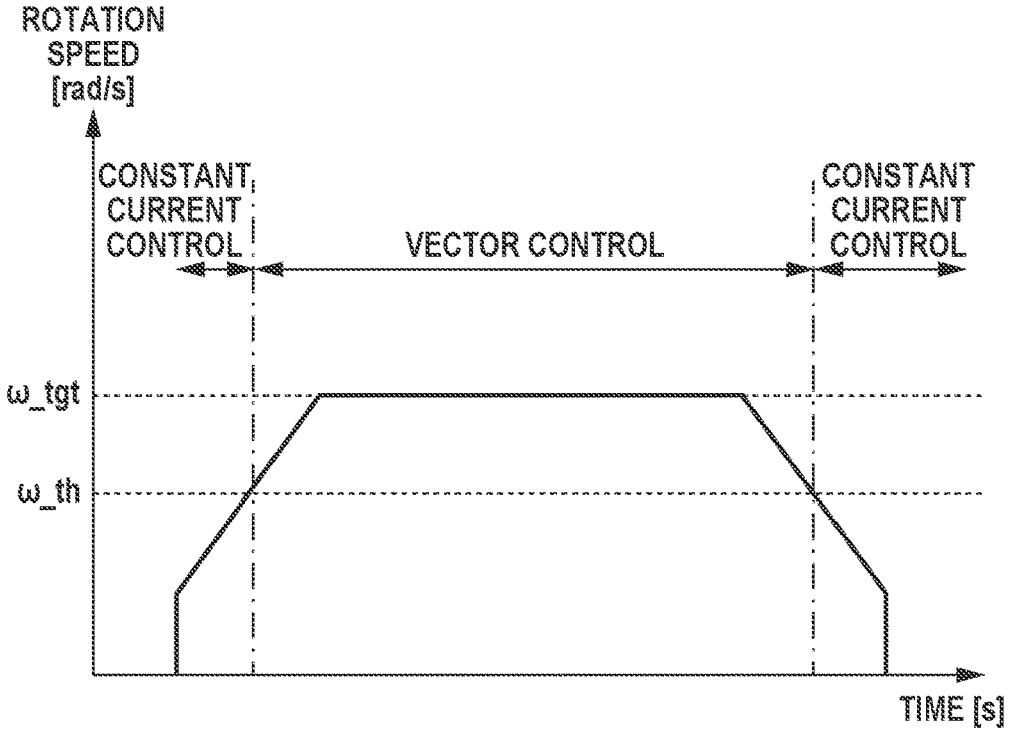
FIGS. 7A and 7B are diagrams illustrating timings of switching vector control and constant current control.
Figure 7B:
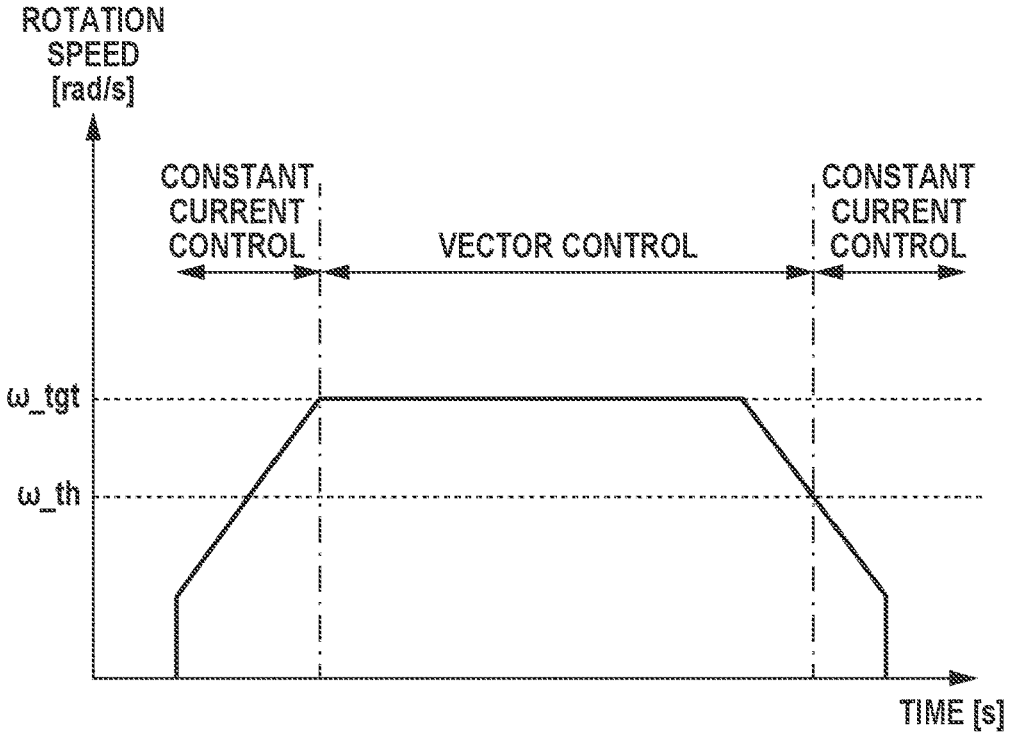

FIGS. 7A and 7B are diagrams illustrating timings of switching the vector control and the constant current control. FIG. 7A is a diagram illustrating a switching timing in a case where the control switcher 515 determines that the previous rotation direction of the motor 509 stored in the memory 515*a* is the same as the rotation direction of the motor 509 indicated in the information output from the CPU 151*a*. FIG. 7B is a diagram illustrating a switching timing in a case where the control switcher 515 determines that the previous rotation direction of the motor 509 stored in the memory 515*a* is different from the rotation direction of the motor 509 indicated in the information output from the CPU 151*a*.

In a state illustrated in FIG. 7A, an increase in load torque resulting from the backlash between a gear arranged on the rotation shaft of the motor 509 and a gear arranged on the rotation shaft of the inverting roller 321 does not occur while the motor 509 is being accelerated. Thus, in a case where the previous rotation direction of the motor 509 stored in the memory 515*a* is the same as the rotation direction of the motor 509 indicated in the information output from the CPU 151*a*, the control switcher 515 switches the control method as follows, in the present exemplary embodiment.

Specifically, the control switcher 515 outputs the switching signal="H" in a case where the rotation speed ω_ref is a threshold ωth or greater (ω_ref≥ωth). On the other hand, the control switcher 515 outputs the switching signal="L" in a case where the rotation speed ω_ref is less than the threshold ωth (ω_ref<ωth). The threshold ωth in the present exemplary embodiment is set to a value greater than a rotation speed ω_min which is the lowest from among the rotation speeds at which the rotation phase θ is determined accurately. Thus, in the vector control, the rotation phase θ is determined accurately. In the constant current control, the rotation phase θ is also determined accurately in a case where the rotation speed of the rotor 402 of the motor 509 is the rotation speed ω_min or greater.

In a state illustrated in FIG. 7B, the backlash between a gear arranged on the rotation shaft of the motor 509 and a gear arranged on the rotation shaft of the inverting roller 321 increases the load torque while the motor 509 is being accelerated. Thus, in a case where the previous rotation direction of the motor 509 stored in the memory 515*a* is different from the rotation direction of the motor 509 indicated in the information output from the CPU 151*a*, the control switcher 515 switches the control method as follows in the present exemplary embodiment.

Specifically, when the rotation speed ω_ref has reached a rotation speed ω_tgt in a state where the constant current control is being performed, the control switcher 515 switches the switching signal to H from L. The rotation speed ω_tgt corresponds to the rotation speed of the motor 509 when a recording medium is conveyed by the inverting rollers 321. In other words, the motor 509 drives the inverting rollers 321 in a state where the rotation speed is the rotation speedω_tgt, which is a predetermined speed.

When the rotation speed ω_ref becomes less than the threshold ωth in a state where the vector control is being performed, the control switcher 515 switches the switching signal to L from H.

As described above, in a case where the previous rotation direction of the motor 509 stored in the memory 515*a* is different from the rotation direction of the motor 509 indicated in the information output from the CPU 151*a*, the control method is switched to the vector control from the constant current control when the rotation speed ω_ref has reached the rotation speed ω_tgt, in the present exemplary embodiment. This prevents unstable control of the motor 509.

In the present exemplary embodiment, in a case where the previous rotation direction of the motor 509 stored in the memory 515*a* is the same as the rotation direction of the motor 509 indicated in the information output from the CPU 151*a*, the control method is switched to the vector control from the constant current control when the rotation speed ω_ref has become the threshold ωth or greater. Thus, in comparison to the case where the rotation direction indicated by the information output from the CPU 151*a* is different from the previous rotation direction of the motor 509, an execution period of the vector control can be extended as much as possible. In other words, it is possible to control consumption of power in driving of the motor 509.

In the present exemplary embodiment, when the rotation speed ω_ref becomes less than the threshold ωth in a state where the vector control is being performed, the control method is switched to the constant current control from the vector control. Thus, an execution period of the vector control can be extended as much as possible. In other words, it is possible to control consumption of power in driving of the motor 509.

In the present exemplary embodiment, in a case where the previous rotation direction of the motor 509 is different from the rotation direction of the motor 509 indicated in the information output from the CPU 151*a*, the control method is switched to the vector control from the constant current control when the rotation speed ω_ref has reached the rotation speed ω_tgt, but this is not restrictive. For example, in a case where the previous rotation direction of the motor 509 is different from the rotation direction of the motor 509 indicated in the information output from the CPU 151*a*, the control method may be switched to the vector control from the constant current control after a predetermined time has elapsed since the starting of the motor 509. The predetermined time is longer than a time when an increase in load torque resulting from the backlash occurs, after the motor 509 is started. The predetermined time is previously determined through experiments and the like.

With respect to a motor for driving the loads to be rotated only in one direction, such as the conveyance rollers 307, a control method may be switched to the vector control from the constant current control when the rotation speed ω_ref becomes the threshold ωth or greater.

While a configuration for switching a control method for a motor for driving the inverting rollers 321 has been described in the present exemplary embodiment, the configuration for switching a control method according to the present exemplary embodiment is applied not only to the inverting rollers 321. For example, the configuration is applicable to the conveyance rollers 320.

Figure 8:
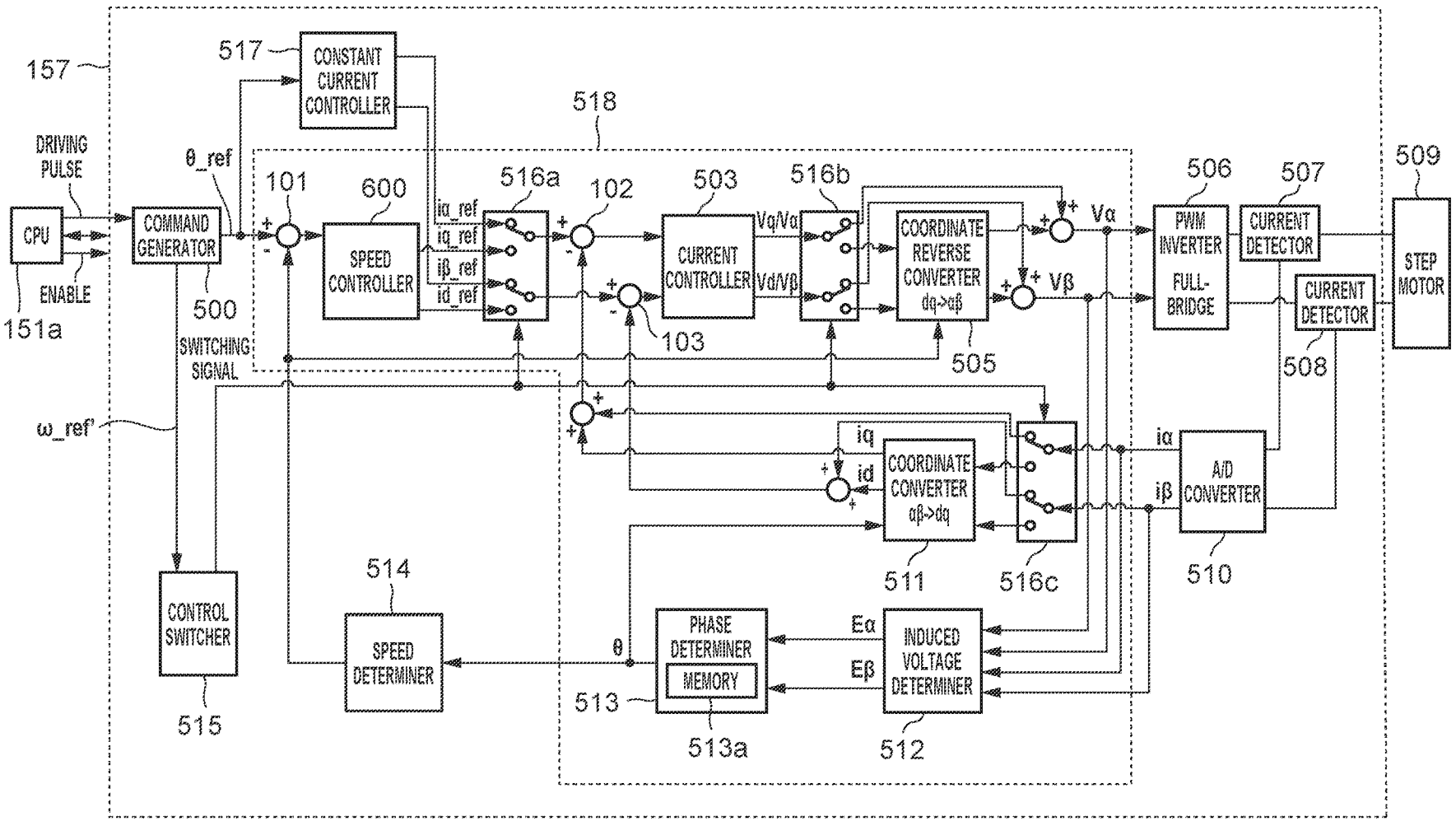
FIG. 8 is a block diagram illustrating a configuration of a motor control apparatus that executes speed feedback control.

While the motor 509 is controlled by performing phase feedback control in the vector control according to the present exemplary embodiment, this is not restrictive. For example, the motor 509 may be controlled by providing the feedback on the rotation speed ω of the rotor 402. More specifically, as illustrated in FIG. 8, the CPU 151*a* outputs the command speed ω_ref indicating the target speed of the rotor 402. The speed determiner 514 inside the motor control apparatus 157 determines the rotation speed ω based on the time variation of the rotation phase θ output from the phase determiner 513. The speed is determined using the following equation (12).

$$\omega = d\theta/dt \tag{12}$$

The speed controller 600 generates the q axis current command value iq_ref so that a deviation between the rotation speed ω and the command speed ω_ref is small, and outputs the result. The motor 509 may be controlled through the above-described speed feedback control. In such configurations, the feedback is provided on the rotation speed, thus controlling a rotation speed of the rotor 402 to gain a predetermined speed.

The motor control apparatus 157 according to the present exemplary embodiment includes partially shared parts with the circuit for performing the vector control and the circuit for performing the constant current control (such shared parts include the current controllers 503 and 504, the PWM inverter 506, and the like). However, the present exemplary embodiment is not limited thereto. For example, a circuit for performing the vector control and a circuit for performing the constant current control may be arranged independently.

The rotation speed ω_ref may be determined based on a period at which a magnitude of the periodic signal, such as the driving current iα or iβ, the driving voltage Vα or Vβ, or the induced voltage Eα or Eβ, related to the rotation period of the rotor 402 becomes zero.

In the present exemplary embodiment, a step motor is used as a motor for driving a load. However, other motors, such as a direct-current (DC) motor and a brushless DC motor, are also useable. The present exemplary embodiment is applicable not only to a two-phase motor but also to other motors, such as a three-phase motor.

In the present exemplary embodiment, a permanent magnet is used as a rotor, but this is not restrictive.

According to the present disclosure, it is possible to prevent an unstable control of a motor.

Embodiments of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described Embodiments and/or that includes one or more circuits (e.g., application specific integrated circuit (ASIC)) for performing the functions of one or more of the above-described Embodiments, and by a method performed by the computer of the system or apparatus by, for example, reading out and executing the computer executable instructions from the storage medium to perform the functions of one or more of the above-described Embodiments and/or controlling the one or more circuits to perform the functions of one or more of the above-described Embodiments. The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc™ (BD)), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2022-100215, filed Jun. 22, 2022, which is hereby incorporated by reference herein in its entirety.

What is claimed is:

1. An image forming apparatus comprising:

an image forming unit configured to form an image on a sheet;

a conveyance roller configured to convey, after inverting a front and a back of the sheet with a first surface on which the image forming unit has formed an image, the sheet to the image forming unit;

a motor configured to drive the conveyance roller;

a gear train configured to transmit driving force of the motor to the conveyance roller;

a detection unit configured to detect driving current flowing through a wound wire of the motor;

a phase determination unit configured to determine a rotation phase of a rotor of the motor based on the driving current detected by the detection unit; and a control unit having a first control mode in which vector control for controlling driving current flowing through the wound wire of the motor is performed based on a torque current component which generates torque in the rotor and is expressed in a rotating coordinate system with the rotation phase determined by the phase determination unit as a reference, and a second control mode in which driving current flowing through the wound wire is controlled based on current with a magnitude determined in advance, wherein the control unit rotates the conveyance roller in a predetermined direction by rotating the rotor in a first direction, and rotates the conveyance roller in a direction opposite to the predetermined direction by rotating the rotor in a second direction opposite to the first direction, wherein the control unit starts controlling the driving current in the second control mode, and then switches, in response to a value corresponding to a rotation speed of the rotor having reached a target speed, a control mode for controlling the driving current from the second control mode to the first control mode, and wherein the target speed is a speed which corresponds to a speed when the conveyance roller conveys the sheet and is a constant value.

2. The image forming apparatus according to claim 1, wherein, when the value corresponding to the rotation speed of the rotor becomes lower than a predetermined speed lower than the target speed in a state where the driving current is controlled in the first control mode, the control unit switches the control mode from the first control mode to the second control mode.

3. The image forming apparatus according to claim 1, wherein, in the first control mode, the driving current is controlled based on the torque current component so that a deviation between the rotation phase determined by the phase determination unit and a command phase expressing a target phase of the rotor is small.

4. The image forming apparatus according to claim 1, further comprising a speed determination unit configured to determine the rotation speed of the rotor, wherein, in the first control mode, the driving current is controlled based on the torque current component so that a deviation between the rotation speed determined by the speed determination unit and a command speed expressing the target speed of the rotor is small.

* * * * *